US007397012B2

(12) United States Patent
Stepniak et al.

(10) Patent No.: US 7,397,012 B2
(45) Date of Patent: Jul. 8, 2008

(54) HIGH CURRENT SWITCH AND METHOD OF OPERATION

(75) Inventors: Frank Stepniak, Andover, NJ (US); Larry Siebens, Asbury, NJ (US); Charles Bindics, Northampton, PA (US); Anthony Reed, Port Murray, NJ (US)

(73) Assignee: Thomas & Betts International, Inc., Wilmington, DE (US)

( * ) Notice: Subject to any disclaimer, the term of this patent is extended or adjusted under 35 U.S.C. 154(b) by 359 days.

(21) Appl. No.: 11/141,571

(22) Filed: May 31, 2005

(65) Prior Publication Data

US 2006/0266630 A1 Nov. 30, 2006

(51) Int. Cl.
*H01H 33/00* (2006.01)

(52) U.S. Cl. ..... 218/155; 200/61.08; 200/300; 218/89; 218/122; 218/139

(58) Field of Classification Search ..... 200/61.08, 200/300; 218/89, 134, 139, 122, 155
See application file for complete search history.

(56) References Cited

U.S. PATENT DOCUMENTS

| | | | | |
|---|---|---|---|---|
| 2,870,298 | A | 1/1959 | Schwager | |
| 3,471,669 | A | 10/1969 | Curtis | |
| 3,812,314 | A | 5/1974 | Nonken | |
| 3,932,717 | A * | 1/1976 | Dike et al. | 200/61.08 |
| 3,955,167 | A | 5/1976 | Kumbera | |
| 4,249,050 | A * | 2/1981 | Okumura | 218/147 |
| 4,316,646 | A | 2/1982 | Siebens | |
| 4,568,804 | A | 2/1986 | Luehring | |
| 4,600,260 | A | 7/1986 | Stepniak et al. | |
| 4,888,455 | A * | 12/1989 | Hanson | 200/61.04 |
| 4,910,367 | A * | 3/1990 | Akers et al. | 218/57 |
| 5,089,931 | A * | 2/1992 | Thuries et al. | 361/174 |
| 5,387,772 | A | 2/1995 | Bestel | |
| 5,721,412 | A * | 2/1998 | Schifko et al. | 218/43 |
| 5,808,258 | A | 9/1998 | Luzzi | |
| 6,130,394 | A * | 10/2000 | Hogl | 218/138 |
| 6,864,456 | B1 | 3/2005 | Banghard et al. | |
| 6,883,804 | B2 | 4/2005 | Cobb | |
| 7,262,362 | B2 * | 8/2007 | Holaus et al. | 174/14 R |

OTHER PUBLICATIONS

"Oil and Vacuum-Break Switches" Cooper Power Systems, Electrical Apparatus 260-20, Feb. 2002.

* cited by examiner

*Primary Examiner*—Michael A Friedhofer
(74) *Attorney, Agent, or Firm*—Hoffman & Baron, LLP

(57) ABSTRACT

An electrical switch which includes an insulative housing having a wall defining an axial bore therein, a first electrical contact disposed in the housing bore and a second electrical contact movably disposed in the housing bore between an open position and a closed position. When the contacts are in their open position, the second electrical contact is spaced apart from the first electrical contact and when the contacts are in their closed position, the second electrical contact is in electrical contact with the first electrical contact. The switch includes features to enhance safety and operation by reducing the possibility of arcing or flashover before and during the switching operation and to provide of visual indication of the state of the switch.

29 Claims, 5 Drawing Sheets

HIGH CURRENT SWITCH AND METHOD OF OPERATION

FIELD OF THE INVENTION

The present invention relates generally to high current switches used in electric power distribution systems and, more particularly, to an electrically insulated, deadfront, single operation, medium voltage, high current closing device.

BACKGROUND OF THE INVENTION

An urban utility experiences approximately 1,500 failures on its network feeders each year. Each feeder outage duration is directly proportional to the risk of customer interruption and the stress experienced by other feeders and transformers in the network. The defective component must remain out of service during repair and/or replacement. This means that the whole feeder remains out of service or a live end cap must be installed to separate the main feeder from the spur containing the defect. If a live end cap is installed, the feeder must be de-energized a second time to reconnect the required spur. This second outage is usually scheduled as soon as possible to restore the system to normal full capability. However, the perceived risk of scheduling the entire feeder out of service to pick-up a small spur is very large, especially during the summer or other high load periods.

Encapsulated switch assemblies with sub-atmospheric or vacuum type circuit interrupters for electric power circuits and systems are well known in the art, such as is shown in U.S. Pat. Nos. 4,568,804; 3,955,167; 3,471,669; 3,812,314; and 2,870,298. In some prior art switch assemblies and circuit breakers, a pair of coacting contacts, one fixed and the other movable, are provided for controlling and interrupting current flow. The contacts are provided in a controlled atmosphere contact assembly which may include a relatively fragile glass or ceramic housing, commonly referred to as a "bottle" for housing the contacts. A metal bellows may be provided on one end of the bottle, and the movable contact is linked to the inside of the bellows. An operating rod attached to the outside of the bellows can be moved so as to move the movable contact inside the bottle. The interior of the bottle is maintained under a controlled atmosphere, such as air or another gas under a low subatmospheric pressure, to protect the contacts from damage caused by arcing when the contacts are opened and closed. The glass or ceramic wall of the bottle provides a permeation-resistant enclosure which maintains the controlled atmosphere for the life of the device.

More recently, elastomer-insulated switch housings using a controlled atmosphere contact assembly have been introduced for underground power distribution systems and other, similar applications. Switches for use in such applications must meet several demanding requirements. Those parts of the switch assembly connected to line voltage during use, including the contact assembly and operating rod, must be encased in a solid insulating housing having dielectric strength sufficient to withstand the maximum voltage which may be imposed on the system, which may be tens of thousands of volts for a distribution-level system. For safety, the insulating housing should be covered with a conductive layer that can be grounded. The switch should be operable from outside of the dielectric housing, without opening the housing and should be capable of withstanding many years of exposure to temperature extremes, water and environmental contaminants.

Elastomers such as EPDM (ethylene propylene diene monomer) combine high dielectric strength with excellent resistance to the effects of ozone and corona discharge. These elastomers can also provide good physical properties such as abrasion resistance, and can be molded at reasonable cost. Additionally, these elastomers can be compounded with conductive additives and molded to provide an electrically conductive grounding layer integral with the dielectric housing. For these and other reasons, elastomers molded and vulcanized under heat and pressure, such as EPDM, have been almost universally adopted as materials of construction for the housings used in many underground electrical distribution systems.

An important feature in such switch assemblies and circuit breakers is the ability to visually determine the switched condition of the contacts. This is obviously important for safety reasons in that power must be disconnected before accessing or repairing a switch branch. U.S. Pat. No. 4,568,804 discloses a high voltage vacuum type circuit interrupter having a one-piece ceramic insulating housing connected to a two-part metallic base. The base encloses a solenoid operated toggle mechanism that controls and operates movement of a switch contact to open and close the switch. The base further includes a sight glass or lens secured to the bottom of the base, through which a switch position indicator is visually discernible.

One drawback with the circuit interrupter disclosed in the '804 patent is its size and complexity in manufacture. Another drawback relates to the fact that the position indicator is located at the toggle mechanism away from the switch contacts. In other words, while the position indicator of the '804 patent may show the condition of the toggle mechanism, there is no provision for visually confirming whether the switch contacts are indeed in contact or separated.

As mentioned above, another concern with such switch assemblies is flashover or arcing of the electric current between switch contacts. Aside from safety concerns, such arcing causes damage to the contacts and the surrounding housing. While efforts to reduce arcing by enclosing the contacts in an evacuated chamber or by insulating the contacts with an arc quenching gas or oil have proven somewhat successful, arcing still occasionally occurs in the field. Additionally, vacuum chambers typically require a housing made from ceramic. Air insulation chambers are generally very large. Chambers filled with $SF_6$ arc quenching gas must be hermetically sealed and maintained to ensure no leakage and insulating oils have been found to fail catastrophically resulting in injury to people and damage to equipment.

Yet another problem with high current switches described above is related to electromagnetic fields which generate undesirable bending forces. In particular, the feeder contact is arranged generally at a 90° angle to the switches current carrying contact pin. These electromagnetic forces are produced on the current carrying members causing a cantilever bending movement at the connection interface.

Accordingly, it is desirable to provide a simply constructed, electrically insulated, switch assembly having direct visible verification of open or closed contacts. It is further desirable to provide such a switch assembly that minimizes the possibility of arcing between electrical contacts and provides good electrical continuity through the switch assembly.

SUMMARY OF THE INVENTION

The present invention is an electrical switch, which generally includes an insulative housing having a wall defining an axial bore therein, a first electrical contact disposed in the housing bore and a second electrical contact movably disposed in the housing bore between an open position and a closed position. When the contacts are in their open position, the second electrical contact is spaced apart from the first electrical contact and when the contacts are in their closed position, the second electrical contact is in electrical contact with the first electrical contact.

In a preferred embodiment, the switch further includes a viewing port disposed in the insulative housing wall adjacent the first electrical contact to permit viewing of the first electrical contact within the housing bore. The viewing port preferably includes a transparent element made from a clear insulative plastic material fixed within the housing wall. The transparent element may further be provided with a magnification feature to enhance viewing and the housing wall may include a protruding boss portion having a hole for receiving the transparent element.

The switch may further include a frangible insulative plate disposed in the housing bore between the first and second electrical contacts when the second electrical contact is in its open position, The frangible insulative plate is adapted to be broken by the second electrical contact as the second electrical contact is moved to its closed position. The frangible insulative plate is preferably made from a high dielectric strength glass material.

Another feature of the present invention is a high current electrical connector system that includes a male pin having a first end and a second end formed by a pair of resilient legs that define a slot; a female socket having a substantially cylindrical side wall and a bottom surface which define a cavity, an open end and a post that extends from the bottom surface. The female socket is configured to receive and electrically contact the second end of the male pin and the slot receives and electrically contacts the post. The male pin can be tapered from the first end to the second end and the post can have a base and a knurled end. Preferably, the slot in the male pin is configured to receive the knurled end. The cylindrical side wall of the female socket can include one or more apertures that are adapted to vent the cavity.

The high current electrical connector system can also include an electrically insulated rod and an actuating mechanism. The electrically insulated rod connects the actuating mechanism to the first end of the male pin.

Another feature of the present invention is an insulating seal ring for electrically insulating a movable energized contact in a housing for a high-current electrical switch. The insulating seal ring includes a generally annular body having an outer wall with an outside diameter that defines an outer sealing surface, an inner wall with an inside diameter that defines an aperture with an inner sealing surface. The outer sealing surface is adapted to be sealably received by the housing and the inner sealing surface is adapted to sealably receive an actuating rod. The insulating seal ring also includes a generally annular core inside the annular body. The body has a first durometer (or hardness) and the core has a second durometer and the materials that form the body and core are selected so that the second durometer is greater than the first durometer. Preferably, the body is formed from an elastomeric polymeric material, such as natural rubbers, synthetic rubbers or fluoropolymers. The body can also be formed from a thermoplastic material, most preferably one that includes a polyethylene, a polypropylene or a polybutylene. The core is preferably formed from a thermoplastic material, an elastic synthetic polyamide material (Nylon), a polycarbonate, an acrylonitrile-butadiene styrene, a polyester terephthalate or a styrene-acrylonitrile.

The insulating seal ring preferably has an outside diameter that is greater than or equal to two times the inside diameter. The body can have a first substantially flat surface and a second substantially flat surface, wherein the distance between the first and second surfaces defines a thickness, and wherein the thickness is greater than or equal to the outside diameter.

In another embodiment, the insulating seal ring includes a generally annular body having an inner concentric layer and an outer concentric layer, wherein the inner concentric layer is formed from a first elastomer material having a first durometer and the outer concentric layer is formed from a second elastomer material having a second durometer, wherein the second durometer is greater than the first durometer. The insulating seal ring can also include a first substantially flat surface and a second substantially flat surface, an outer wall with an outside diameter that defines an outer sealing surface and an inner wall with an inside diameter that defines an aperture having an inner sealing surface, preferably the outside diameter is greater than or equal to two times the inside diameter. The distance between the first and second surfaces defines a thickness which is preferably greater than or equal to the outside diameter. The outer sealing surface is adapted to be sealably received by the housing and the inner sealing surface is adapted to sealably receive the actuating rod.

The inner concentric layer and the outer concentric layer are formed from different elastomeric materials selected from the group consisting of natural rubbers, synthetic rubbers, and fluoropolymers. The outer concentric layer material is selected so that its durometer is greater than the durometer of the inner concentric layer material. The outer concentric layer material can also be an elastic synthetic polyamide material (Nylon), polycarbonate, acrylonitrile-butadiene styrene, or styrene-acrylonitrile.

The switch assembly may further include method and apparatus for reducing bending forces on an electrical connection point. More specifically, the feeder contact and current carrying male pin are electrically coupled and include longitudinal axes which are substantially non-parallel. The feeder contact preferably includes a mechanically weakened portion adjacent the electrical connection. Upon closing of the switch, high current flows through the male pine and feeder contact generating electromagnetic bending forces. These bending forces tend to act on the electrical connection thereby loosening or damaging the connection. The mechanically weakened portion directs the bending forces away from the electrical connection to reduce undesirable bending forces on the connection point.

The preferred embodiments of the switch of the present invention, as well as other objects, features and advantages of this invention, will be apparent from the following detailed description, which is to be read in conjunction with the accompanying drawings.

DETAILED DESCRIPTION OF THE PREFERRED EMBODIMENTS

Figure 1:
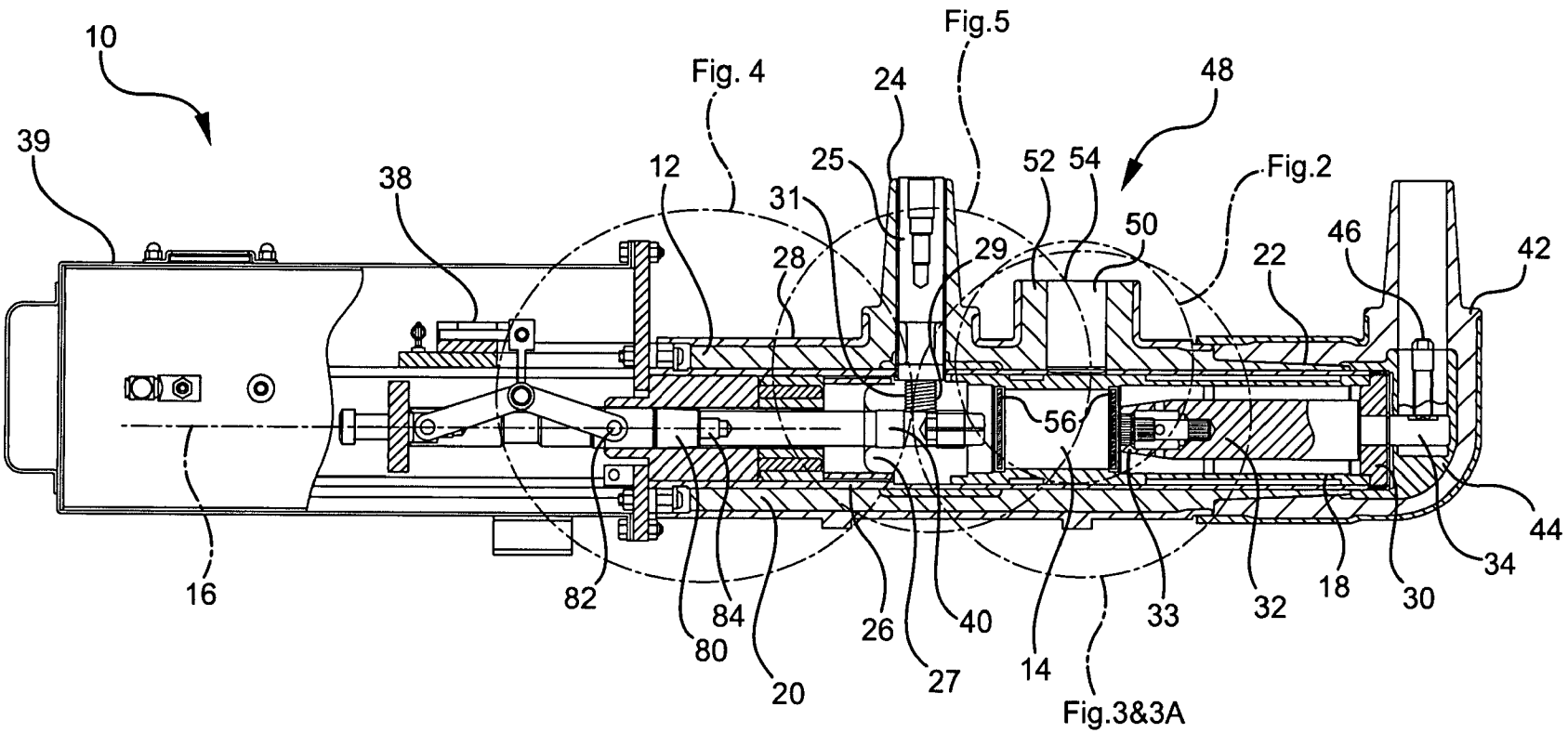
FIG. 1 is a cross-sectional view of the switch according to the present invention.

Referring first to FIG. 1, in a preferred embodiment, the switch 10 according to the preferred embodiment of the present invention is a medium-voltage, one-operation switch. As used in this disclosure with reference to apparatus, the term "medium voltage" means apparatus which is adapted to operate in electric utility power systems, such as in systems operating at nominal voltages of about 5 kv to about 35 kv, commonly referred to as "distribution" systems, as well as equipment for use in "transmission" systems. A high current switch of this type is disclosed in commonly owned U.S. Pat. No. 5,808,258, the disclosure of which is incorporated herein by reference in its entirety.

The term "one-operation" generally means a device used to temporarily interrupt power between a "feeder" or "source" circuit and a "spur" circuit in order to safely access or effect repairs on the spur circuit. Upon successful repairs of the spur circuit, the switch is closed to restore power to the spur circuit and is replaced by a permanent connection at a later low load planned outage.

The switch 10 includes a housing 12 formed from a dielectric elastomer which is vulcanized under heat and pressure, such as ethylene propylene diene monomer (EPDM) elastomer. The housing 12 defines an elongated bore 14 extending in endwise directions parallel to an axis 16. The housing has a terminal end 18 and a second, opposite end 20, referred to herein as the operating end. For reasons discussed below, the direction parallel to axis 16 toward terminal end 18 is referred to herein as the closing endwise direction, whereas the opposite endwise direction, towards operating end 20 is referred to as the opening endwise direction.

The housing defines a tapered bushing 22 at the fixed end and a further tapered bushing 24 extending perpendicular to the endwise axis. Bushing 24 has a cylindrical metallic current-carrying element 25 extending therein to the bore 14 in a direction perpendicular to axis 16. This current-carrying element 25 of the bushing 24 is generally adapted for electrical connection to the "spur" circuit of the power distribution system, as described above.

The portion of the housing 12 disposed between the tapered bushing 22 and the operating end 20 has a generally cylindrical exterior surface, so that the wall of the housing in this region is generally in the form of a cylindrical tube. The housing is provided with an electrically conductive insert 26 formed from a mixture of the same elastomer used for the remainder of the housing and an electrically conductive material such as carbon black. Insert 26 covers the interior wall of bore 14 from the operating end 20 to a point adjacent the bushing 24.

Overlying the majority of the exterior surface of the housing 12 is a conductive jacket 28. The bushing 24 extends from the housing through a hole in the conductive jacket 28. The conductive jacket 28 may also be formed from a mixture of the same elastomer used for the remainder of the housing and an electrically conductive material such as carbon black. The exterior conductive jacket 28 is in intimate, void-free contact with the outside of the housing 12, and is securely bonded thereto. Likewise, the semiconducting lining 26 is intimately bonded to the dielectric elastomer of the housing 12. These components may be fabricated by insert molding, as described in U.S. Pat. No. 5,808,258, which was previously incorporated by reference.

Fixed at the terminal end 18 of the housing 12 is a metallic terminal end closure 30, which seals the central bore 14 at the terminal end. A fixed contact 32 is mounted to the terminal end closure 30 and projects into the central bore 14 of the housing 12. The fixed contact 32 includes an engagement end 33 and further includes a terminal end stub contact 34 formed integrally with the fixed contact, which projects outwardly from the central bore 14 beyond the terminal end closure 30.

The switch 10 further includes an actuating device 38 mounted to the operating end 20 of the housing 12. The actuating device 38 is connected to a moveable or operating-end male contact pin 40 extending into the central bore 14 of the housing 12. The contact pin 40 is in electrical contact with the first cylindrical metallic current-carrying element 25 disposed in the second bushing 24. More specifically, the first current carrying element 25 includes a threaded end 29 which is received in a threaded bore 31 of a donut contact 27. The donut contact 27 includes an axial bore to slidingly electronically communicate with the contact pin 40. The first current carrying device or post contact 25 includes a central axial bore therein to receive the post of the high voltage connector, such as an elbow connector (not shown). The contact pin 40 is driven by the actuating device 30 in the closing endwise direction from an open position, as shown in FIG. 1, to a closed position, wherein the contact pin engages the fixed contact 32. The actuating device 38 moves the contact pin 40 rapidly between opened and closed positions so as to minimize arcing.

The actuating device 38 is preferably extremely compact and accommodated in a tubular housing 39 of essentially the same diameter as the switch housing 12. An O-ring or other conventional seals (not shown) can be provided between the actuator housing 39 and the switch housing 12 so as to provide a weather-tight seal protecting the elements of the actuating mechanism 38. Any of the numerous drive mechanisms known in the art for moving switch contacts can be used in the switch 10. For example, pneumatically-operated devices, solenoid-actuated devices, spring-operated devices and other known mechanisms can be used. Moreover, these can be either manually activated or automatically activated by a control system or by a sensor associated with the switch for detecting a condition in the circuit.

The interior central bore 14 surrounding the fixed contact 32 and the contact pin 40 is preferably at atmospheric pressure and filled with air. Alternatively, the central bore 14 may include a controlled atmosphere therein. As used in this disclosure, the term "controlled atmosphere" means an atmosphere other than air at normal atmospheric pressure. When using a controlled atmosphere, it is preferred that the central bore 14 is maintained at a subatmospheric pressure. The composition of the controlled atmosphere may also differ from normal air. For example, arc-suppressing gases such as $SF_6$ may be present within the bore.

The switch 10 further includes a terminal end cover 42 formed from a dielectric elastomer similar to the housing 12. The cover 42 may include a terminal end electrical stress relief element 44, formed from a semiconducting elastomer, disposed therein. The terminal end cover 42 is positioned on the housing 12 so that an internal taper in the cover is firmly engaged with the conical seat 22 at the terminal end 18 of the housing and so that the electrical stress release element 44 surrounds the contact stub 34 extending out of the terminal end of the housing. The terminal end cover has a second cylindrical metallic current carrying element 46 mounted therein, which is electrically coupled to the contact stub 34. This second current-carrying element 46 of the end cover 42 is generally adapted for electrical connection to the "feeder" or "source" circuit of the power distribution system, as described above.

In operation, the switch 10 is connected in the circuit through current-carrying elements 25 and 46, and hence through terminals 40 and 34. In the position illustrated in FIG. 1, the switch is open. To close the switch, the actuating device 38 is activated to axially translate the movable contact pin 40 in the closing direction toward the fixed contact 32 until the two are mechanically and electrically engaged. As mentioned above, this movement occurs suddenly, thereby minimizing any possibility of arcing between the contacts.

Figure 2:
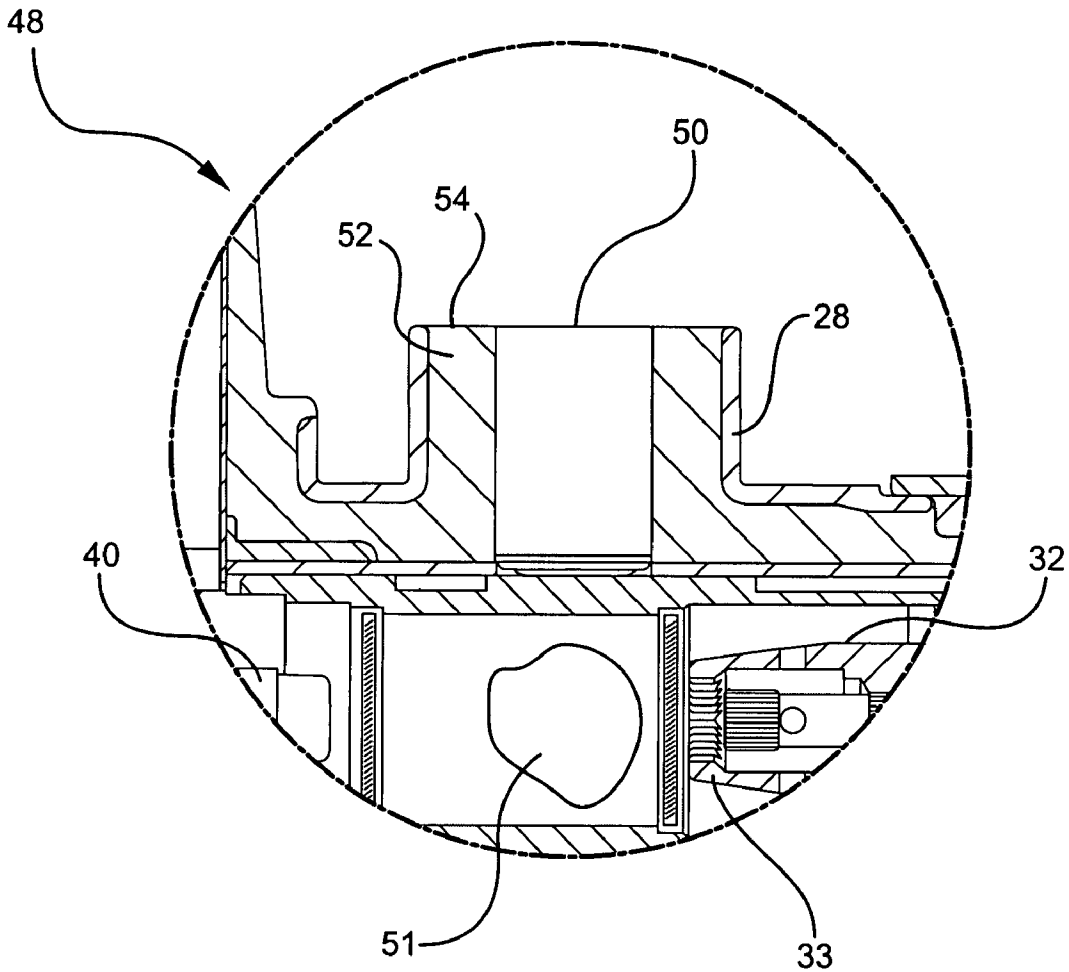
FIG. 2 is a detailed cross-sectional view of the viewing port of the present invention.

Referring additionally to FIG. 2, to visually confirm the condition of the internal contacts 32 and 40 with respect to each other (i.e., open or closed), the switch housing 12 is provided with a viewing port 48 positioned directly adjacent the engagement end 33 of the fixed contact 32. The viewing port 48 is preferably in the form of a transparent element 50 fixed within the insulative material of the housing 12 so as to provide visual access into the interior bore 14 of the housing at a point 51 directly adjacent the engagement end 33 of the fixed contact 32. The transparent element 50 is preferably made of a clear insulative plastic material and may be provided with a magnifying feature to enhance viewing. However, any insulating material having a sufficient level of transparency can be used for the transparent element 50.

The transparent element 50 may be press-fit or bonded within a hole of the housing 12 formed during molding of the housing. In this regard, it is preferred to form the housing 12 with a protruding boss portion 52 having a hole for receiving the transparent element 50. By providing the boss portion 52, the depth of the hole can be increased, thereby increasing the contact surfaces between the hole and the transparent element 50 to enhance the hold therebetween. An electrical stress grading coating can also be applied between the hole surface and the transparent element 50 to ensure adequate electrical interface therebetween.

The conductive jacket 28 of the switch housing 12 preferably extends upwardly to cover the side walls of the boss portion 52 and defines an opening for the end face 54 of the boss portion. Thus, the transparent element 50 penetrates the insulation wall of the housing 12 while maintaining the insulative layer between the energized contacts 32 and 40 and the external grounded shield 28 of the housing. A cap (not shown) is provided to cover the viewing port to keep it free from debris.

Figure 3A:
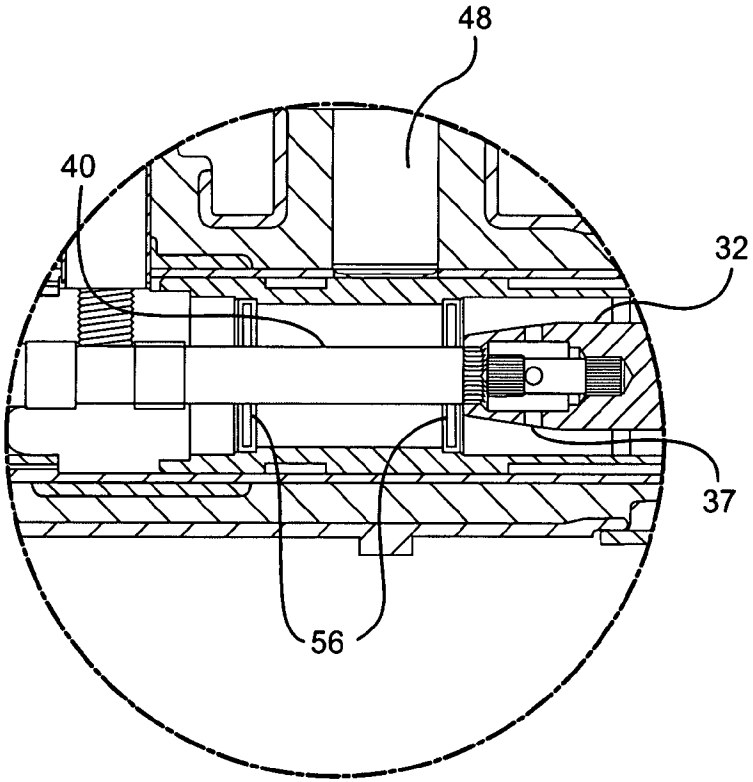
FIG. 3*a* is a cross-sectional view of the housing central bore shown in FIG. 3 with the contacts in a closed position and the glass plates broken.
Figure 3:
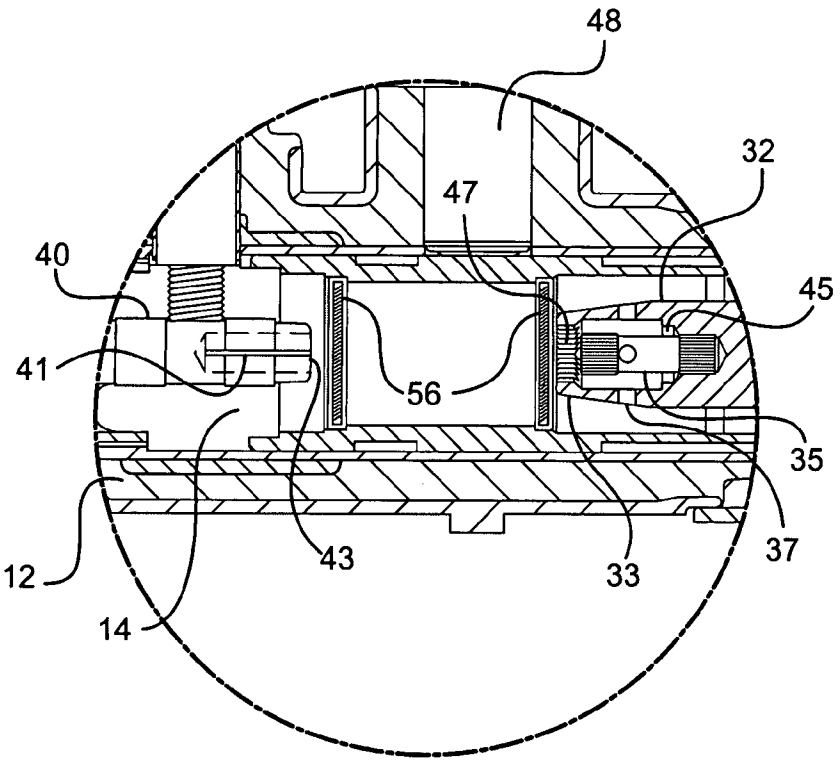
FIG. 3 is a cross-sectional view of the housing central bore showing the space between the open contacts separated by glass insulating plates.

Referring now additionally to FIG. 3, to further minimize arcing between the movable contact pin 40 and the fixed contact pin 32, the housing 12 of the present invention further preferably includes at least one frangible insulative plate 56 fixed in the housing central bore 14 between the contacts. The plate 56 is preferably made from a high dielectric strength glass, about ⅛" thick, which can be fixed in the central bore 14 during molding of the housing 12. In the preferred embodiment, the housing 12 includes two glass plates 56 disposed adjacent respective contacts 32 and 40.

As a result, the contacts 32 and 40 can be separated by air without the need for a large volume. Moreover, the contacts 32 and 40 can be placed closer together since the glass plates 56 serve to increase the static dielectric strength between the contacts to control the arcing during closure. The glass plates 56 provide the limited arc time needed for a successful metal to metal connection to extinguish any arc.

In operation, the normally open switch 10 can be installed between a faulted spur circuit and a source circuit after shutting off the voltage source. The spur circuit is grounded via the first current carrying element 25 of the switch while the source circuit is connected to the second current carrying element 46. Grounding of the spur circuit and disconnection of the source circuit is easily confirmed by viewing the open position of the contacts 32 and 40 within the housing bore 14 through the viewing port 48. The faulted spur circuit can now be safely repaired.

Once repaired, the actuating mechanism 38 can be activated to translate the movable contact pin 40 forward toward the fixed contact 32. As the contact pin 40 travels, it breaks the nearest glass plate 56 but is still insulated by arcing by the far glass plate situated directly in front of the fixed contact 32. Only when the second glass plate 56 is broken will an arc strike, but by this point, the pin 40 is already into engagement with the engagement end 33 of the fixed contact 32, as shown in FIG. 3*b*. Engagement of the contacts 32 and 40 is also easily confirmed with the viewing port 48.

Thus, power is restored to the spur circuit without interruption of power in the source circuit. The advantage of the switch 10 is that service is maintained to the majority of power customers on other spur circuits during the repair of the faulted spur circuit and a second interruption is prevented to restore power to the faulted spur circuit during a high load period. The switch 10 can be subsequently removed and replaced with a permanent connection during a low load planned outage.

FIG. 3 shows an electrical contact system that includes a movable male pin 40 and a stationary female socket contact 32. In FIG. 3, the male pin 40 and the female socket 32 are in the open position and in FIG. 3*a* the contacts 32, 40 are in the closed position. The pin contact 40 is segmented into sections 41 and a portion of its longitudinal axis is bored out to form a slot 43 which accepts a post 35 provided in the center of the female contact 32. Preferably, the segmented section of the pin contact 40 is tapered and the segmented sections or fingers provide some resilient spring when engaging the female socket. The female contact 32 is cylindrically-shaped with a bottom surface 45 and an inner side wall 47 extending from the bottom surface. In addition, the internal post 35 inside the female socket 32 extends from the bottom surface 45 and is configured to be received by the axial bore or slot 43 in the male pin 40 so that the pin 40 is trapped between the inner wall 47 of the female socket and the outer wall of the internal post 35 to prevent any movement upon coupling of the pin and socket. The inside wall 47 of the socket 32 and outer surface of the post 35 preferably include a roughened surface, such as being serrated or knurled. Multiple contact surfaces and the scraping action of the serrated surfaces provide good high current transfer and prevent broken shards of glass from interfering with the connection.

In a preferred embodiment, the stationary female contact 32 is connected to one 600 A separable connector rod contact 46 and the movable male pin 40 is physically connected to, but electrically insulated from, the actuating mechanism 38. The pin 40 passes through and is slidingly electrically coupled, preferably by means of a spring contact, to the donut contact 27. As earlier described, the donut contact 27 includes a threaded bore 31 to receive the threaded end 29 of the first current carrying contact 25.

In the open position of the preferred embodiment, the electrical contact system has approximately 3.5 inches separating the male pin contact 40 and the female socket contact 32. However, in other embodiments, the separation distance can vary from about 2 to 6 inches or more. The insulation medium between the contacts is air and glass. The two ⅛-inch thick glass plates 56 provide a dual function of maintaining dielectric strength across the open contacts, and controlling the arc distance and time between the closing contacts. One ⅛-in thick glass plate 56 provides sufficient dielectric strength to prevent an arc strike until the glass plate 56 is broken by the closing pin contact 40. Considering the contact chamber is a closed vessel, and the current can be a maximum of 40 kA symmetrical, it is critical to limit the arc energy for a successful close. Excess arc energy will cause a rapid increase of pressure and excess erosion of the contacts. This will result in a housing rupture and fault to ground. With the ⅛-in thick glass plate and a contact closing speed of 387 in/sec, the arcing time is limited to approximately 0.32 milliseconds. Fault-close tests at 40 kA have demonstrated successful closure with minimal damage to the contacts.

The male pin 40 is electrically isolated from the actuating mechanism 38 by a non-conductive coupling (or actuating) rod 80, preferably made of fiberglass. The first end 82 of the rod 80 is connected to the actuating mechanism 38 and the second end 84 is connected to the pin contact 40. When the contacts 32, 40 are open, the pin contact 40 side is connected to the feeder, which is grounded, and voltage withstand need not be considered. When the contacts 32, 40 are closed and energized, the pin contact 40 is insulated from the grounded actuating mechanism 38 by the insulated coupling rod 80.

Figure 4:
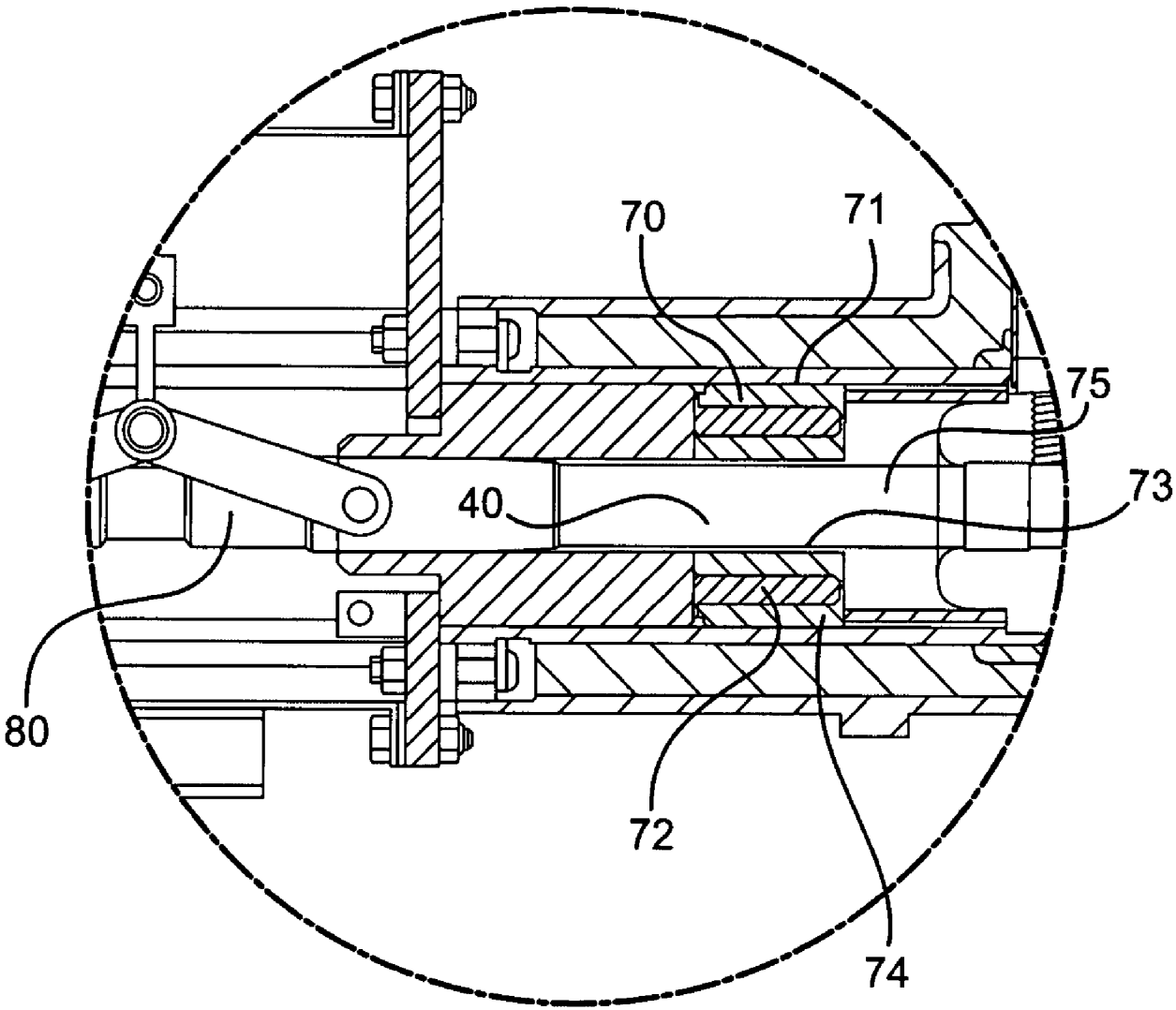
FIG. 4 is a cross-sectional view of the insulating seal ring and actuating rod.

Another feature of the present invention, is an insulating seal ring 70 as shown in FIG. 4. Any medium or high voltage switch having an electrically grounded mechanism that is mechanically connected to and operates an energized contact must have an insulating barrier between the two to prevent flashover or creep. The insulating barrier must maintain a continuous seal when the switch is actuated without interfering with the travel of the actuating mechanism of the switch. By controlling the frictional interference level between the sealing surface of the ring and the rod, the seal can be maintained over the entire travel of the rod. This concept can be used in most types solid dielectric switches.

FIG. 4 shows an insulating seal ring 70 for electrically insulating the movable energized contact 40 in the housing 12 of the high current switch 10. The insulating seal ring 70 is generally donut shaped with sealing surfaces 71, 73 on the respective outer and inner circumferences of its annular body. The insulating seal ring 70 has a ring-shaped core 72 that is covered with an insulating layer 74. The core 72 is formed from material that is harder than the insulating layer 74 material so that the core 72 has a stiffening effect on the insulating layer 74. In another embodiment, the insulating seal ring 70 is formed from two concentric rings of different materials, wherein the material that forms the outer ring is harder than the material that forms the inner ring. This allows the inner sealing surface 73 to be less stiff and have different sealing properties from the sealing surface on the outside surface.

The actuating rod 80 that connects the energized contact pin 40 and the actuating mechanism 38 of the switch 10 shown in FIG. 1 preferably has an insulating barrier between the contact pin 40 and the actuating mechanism 38, which allows about 4 inches of movement. The insulating seal ring 70 provides an electrically insulated barrier that permits the rod 80 substantially unrestricted travel over most of its length.

The inner diameter of the insulating seal ring 70 has an inner sealing surface 73 which is sized based on the diameter of the rod 80 that connects the pin contact 40 and the actuating mechanism 38. The rod 80 is formed from an insulating material and has a diameter configured so that the inner sealing surface 73 does not sealably engage the rod 80 until it has substantially reached the end of its travel. The frictional interferences of the outer sealing surface 71 and the inner sealing surface 73 provide an electrically insulating seal between the switch contacts 32, 40 and the actuating mechanism 38. The stiff core 72 of the insulating seal ring 70 allows the inner and outer sealing surfaces 71, 73 to operate independently, without a significant transfer of the forces from one surface to the other surface. Thus, tracking on the surface of the rod 80 is prevented by the inner sealing surface 73 of the insulating seal ring 70 which provides electrical insulation around the rod 80. Similarly, the outer sealing surface 73 of the insulating seal ring 70 provides electrical insulation with the inner surface of the housing chamber 12. The insulating seal ring 70 provides the required AC, DC and BIL withstand levels between the open contacts and between the contacts and case ground.

In a preferred embodiment, the insulating seal ring 70 is formed from a plastic ring-shaped core 72 that is overmolded with an insulating layer 74 of an elastomer material, preferably rubber. The outer diameter ("OD") of the insulating seal ring 70 defines an outer sealing surface 71 that is configured to sealably contact the generally cylindrical, inside wall of the switch housing 12. The aperture 75 in the insulating seal ring 70 has an inner diameter ("ID") which is configured to sealably receive the rod 80 and provide electrical isolation between the actuating mechanism 38 and the high current pin 40 and socket 32 electrical contact system.

More specifically, the rod 80 is formed from an insulating material, such as fiberglass, a thermoplastic material or other non-conductive material with sufficient hardness to maintain structural integrity during the operation of the switch 10. The rod 80 has a first end 82 that is connected to the electrical pin connector 40 and a second end 84 that is connected to a actuating mechanism 38. Actuation of the switch 10 moves the rod 80 through the aperture 75 in the insulating seal ring 70. The rod 80 is shaped so that the outside diameter of the rod 80 at the second end 84 allows it to pass through the aperture 75 in the insulating seal ring 80 without sealably contacting the inner sealing surface 73 of the ring 70 over most of its travel. At the point where the rod 80 nears the end of its travel, the diameter near the first end 82 of the rod 80 passing through the aperture 75 in the ring 70 increases so that the rod 80 sealably contacts the inner sealing surface 73 of the ring 70 that prevents arcing from one side of the ring 70 to the other.

Preferably, the rod 80 has at least a first diameter, which allows it to unobstructively pass through the aperture 75 in the ring 70, and a second diameter which sealably contacts the inner sealing surface 73 of the ring 70. However, other configurations of the rod 80 such as a tapered construction or more than two different diameters are also contemplated by the invention.

The outer and inner sealing surfaces 71, 73 of the insulating seal ring 70 provide electrically insulating seals between the ring 70 and the housing 12 and the ring 70 and the rod 80. The insulating seal ring 70 can withstand the voltage gradient that occurs when the switch 10 closes and isolates the switch contacts 32, 40 inside the housing 12. The rigid core 72 allows independent frictional interference levels at the sealing surfaces 71, 73 and prevents the force applied on one sealing surface from being transferred to the other sealing surface. In addition to minimizing the transfer of forces between the two sealing surfaces 71, 73, the ring-shaped core 72 evenly distributes any force that is transferred.

The configuration and dimensions of the core 72, as well as the thickness of the insulating layer 74 on either side of the core 72, provides adjustable levels of friction at the sealing surfaces 71, 73. The harder material of the core 72 acts as a stiffener for the insulating layer 74 on either side of the ring 70. The closer the core 72 is to the sealing surfaces 71, 73, the greater the stiffening effect on the insulating layer 74. A thicker core 72 results a less flexible insulating layer 74 and hence more friction at the sealing surfaces 71, 73. While a smaller core 72 results in an insulating layer 74 with more flexibility and movement and hence less friction on the rod 80.

The insulating seal ring 70 engages the rod 80 at its inner sealing surface 73 and the switch housing 12 at its outer sealing surface 71. The frictional interference level required to properly seal these two surfaces is different. The rigid plastic core 72 allows the stiffness of each sealing surface 71, 73 to be designed for the specific application and controlled independently. Preferably, the core 72 is designed to provide an insulating seal ring 70 having a higher frictional interference level with greater stiffness at the substantially stationary outer sealing surface 71 and a lower frictional interference level with less stiffness at the inner sealing surface 73. The lower frictional interference level of the inner sealing surface 73 allows substantially unrestricted movement of the rod 80 through the aperture 75 in the insulating seal ring 70. Without the plastic core 72, forces on one of the sealing surfaces would be transferred to the other sealing surface.

Alternatively, as will be understood by those skilled in the art, the insulating seal ring 70 can be formed from an elastomer without a core, preferably a rubber, which sealably contacts the switch housing at the outer sealing surface and sealably contacts the rod at the inner sealing surface. In one embodiment, the insulating seal ring can be made from two concentric rings formed from elastomer materials having different durometers (hardness). The elastomer that forms the outer ring preferably has a higher durometer and is stiffer, while the inner ring is formed from a lower durometer elastomer which is less stiff and facilitates the travel of the rod through the insulating seal ring. The two elastomer rings are bonded together using methods well known to those skilled in the art.

Figure 5:
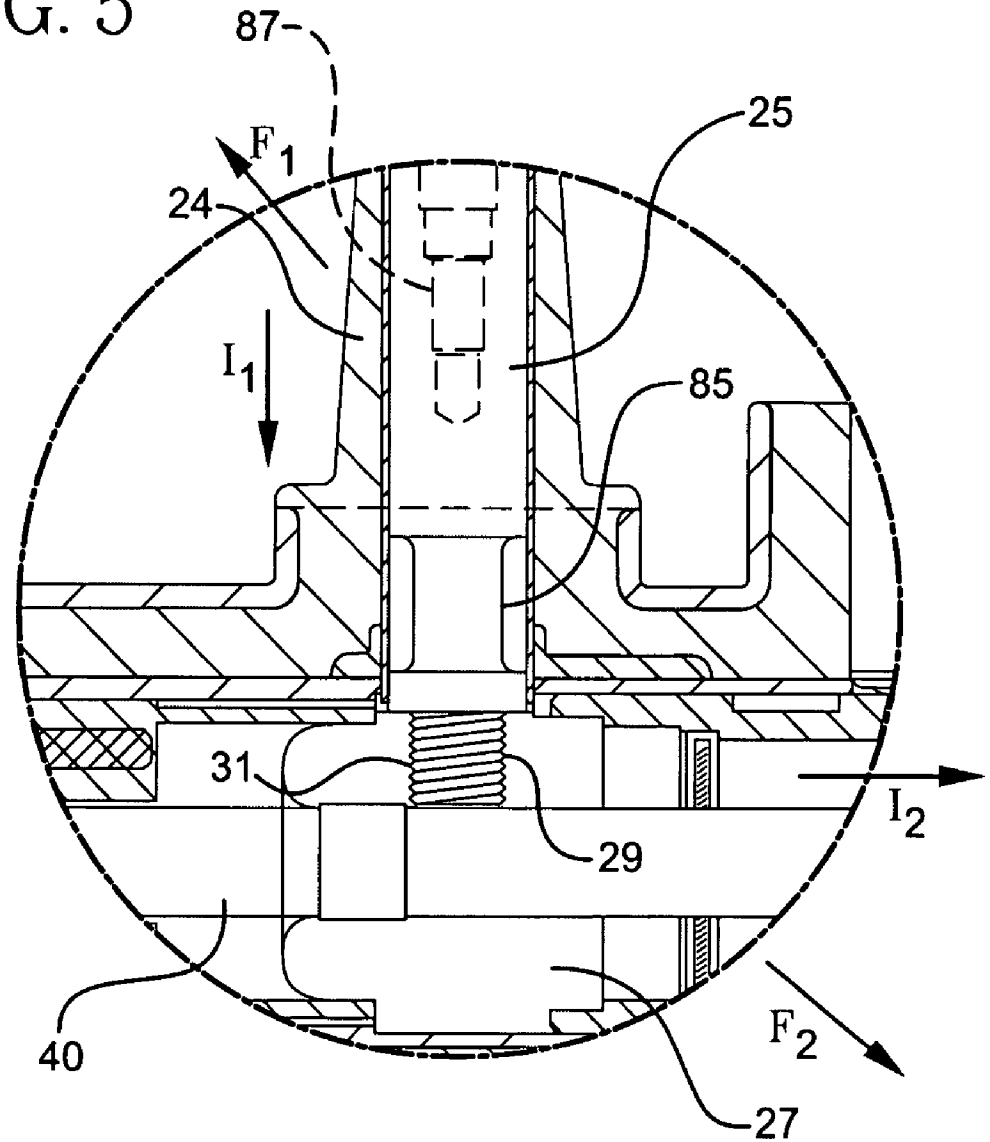
FIG. 5 is a cross-sectional view of the feeder post contact and male pin electrical connection.

Yet another feature of the present invention is the provision of a mechanical weak point on the spur side first current carrying contact 25 to accommodate electromagnetic forces generated upon electrical connection. As shown in FIG. 5, the switch 10 includes a contact pin 40 located within a central bore 14 thereof. As previously discussed, the contact pin 40 is provided to be axially movable within the bore 14 and makes electrical contact with a contact donut 27. The contact donut 27 includes a threaded bore 31 to receive the threaded end 29 of first current carrying contact 25 to provide a current path from the first current carrying contact to the contact pin 40. The first current carrying contact 25 extends at approximately a 90° angle with respect to the contact pin 40 and provides a current path through the switch. The first current carrying contact 25 is housed within the bushing 24 and includes a central axial bore 87 therein adapted to receive an electrical contact from a spur side separable connector (not shown). The separable connector may preferably take the form of a high voltage elbow connector such as an Elastimold® K655 LR, rated 25 kv, 600A available from Thomas & Betts Corporation, Memphis, Tenn.

The mechanical weak point of the present invention is provided on the first current carrying contact 25 near the threaded end 29 thereof. The mechanical weak point is preferably in the form of a recessed portion 85 of the contact 25. The purpose of the mechanical weak point is to permit some degree of bending to accommodate electromagnetic forces from distorting and/or loosening the connection between the threaded end of the contact 25 and the donut contact 27. More specifically, during high current flow as illustrated by arrows $I_1$ and $I_2$, electromagnetic forces illustrated by arrows $F_1$, and $F_2$ are produced on the current carrying members. It has been found that such forces applied to an unsupported electrical contact point, such as a rigid threaded contact 25 not including the recessed portion tended to distort and/or loosen the threaded connection between the contact 25 and donut contact 27. This distortion or loosening of the connection has been found to weaken the electrical connection and lead to possible failure of the device.

The electromagnetic forces generate a bending force because the current flows through the first current carrying contact into the switch device and makes a right angle turn to the contact pin 40 and socket contacts 32. Accordingly, the electromagnetic force generated by the current flowing through the contact 25 is in a direction different from the electromagnetic forces generated by current flowing through the contact pin 40 and socket contacts 32 as shown by arrows $F_1$ and $F_2$. These electromagnetic forces act in different directions and tend to try to straighten the current flow path creating undesirable bending forces on the electrical system assembly components and especially at the juncture between the first current carrying contact 25 and contact pin 40.

The present invention provides a solution to accommodate these electromagnetic forces and maintain a good electrical connection during high current operation. The first current carrying contact is provided with a recessed portion 85 such that the bending forces are directed to the mechanical weak point of the contact relieving the stress on the threaded connection. Stated differently, the bending forces will tend to bend the contact 25 in the recessed portion thereby reducing the stress on the electrical connection point. In a preferred embodiment, the first current carrying contact may be formed of a conductive material having increased maleability so that forces generated on the post contact tend to bend the contact at the mechanical weak point or undercut, not tend to loosen or distort the electrical connection point.

The mechanical weak point or recessed portion of a contact to permit some bending in the region can be applied to any high current application where limiting bending forces is desirable. Such an electrical contact system is particularly useful in reducing electromagnetic bending forces to prevent damage or failure of a connection point wherein the longitudinal axes of the contacts is substantially non-parallel. The provision of the recessed portion on the contact can be used with a variety of different connections, such as threaded, welded, soldered, sliding, crimp or any other known electrical connection method to direct bending forces away from the connection point.

Although preferred embodiments of the present invention have been described herein with reference to the accompanying drawings, it is to be understood that the invention is not limited to those precise embodiments and that various other changes and modifications may be affected herein by one skilled in the art without departing from the scope or spirit of the invention, and that it is intended to claim all such changes and modifications that fall within the scope of the invention.

For example, while the switch of the present invention has been primarily described herein as a medium-voltage, one-operation switch, those skilled in the art will appreciate that the switch of the present invention may also be employed in any high-current application, wherein a switching operation under load is required. Such other devices are intended to come within the scope of the invention. In particular, the switch of the present invention may be designed for multiple and/or continuous operation and may further be additionally rated for low and/or high voltages.

What is claimed is:

1. An electrical switch comprising:

an insulative housing having a wall defining an axial bore therein, said housing including a conically tapered first end, a cylindrical mid-section, a conically tapered bushing formed in said mid-section perpendicular to said axial bore and a boss portion formed in said mid-section perpendicular to said axial bore between said tapered first end and said tapered bushing;

a first electrical contact disposed in said housing bore;

a second electrical contact movably disposed in said housing bore between an open position, wherein said second electrical contact is spaced apart from said first electrical contact, and a closed position, wherein said second electrical contact is in electrical contact with said first electrical contact; and a viewing port disposed in said boss portion of said insulative housing wall adjacent said first electrical contact to permit viewing of said first electrical contact within said housing bore.

2. An electrical switch as defined in claim 1, wherein said viewing port comprises a transparent element positioned within said housing wall.

3. An electrical switch as defined in claim 2, wherein said transparent element is made from a clear insulative plastic material.

4. An electrical switch as defined in claim 2, wherein said transparent element is provided with magnification to enhance viewing.

5. An electrical switch as defined in claim 1, further comprising a frangible insulative plate disposed in said housing bore between said first and second electrical contacts when said second electrical contact is in said open position, said frangible insulative plate being adapted to be broken by said second electrical contact as said second electrical contact is moved to said closed position.

6. An electrical switch comprising:

an insulative housing having a wall defining an axial bore therein;

a first electrical contact disposed in said housing bore;

a second electrical contact movably disposed in said housing bore between an open position, wherein said second electrical contact is spaced apart from said first electrical contact, and a closed position, wherein said second electrical contact is in electrical contact with said first electrical contact;

a viewing port disposed in said insulative housing wall adjacent said first electrical contact to permit viewing of said first electrical contact within said housing bore; and a frangible insulative plate disposed in said housing bore between said first and second electrical contacts when said second electrical contact is in said open position, said frangible insulative plate being adapted to be broken by said second electrical contact as said second electrical contact is moved to said closed position, wherein said frangible insulative plate is made from a high dielectric strength glass material.

7. An electrical switch as defined in claim 6, wherein said viewing port comprises a transparent element positioned within said housing wall.

8. An electrical switch as defined in claim 7, wherein said transparent element is made from a clear insulative plastic material.

9. An electrical switch as defined in claim 7, wherein said transparent element is provided with magnification to enhance viewing.

10. An electrical switch as defined in claim 7, wherein said housing wall includes a protruding boss portion having a hole for receiving said transparent element.

11. An electrical switch comprising:

an insulative housing having a wall defining an axial bore therein;

a first electrical contact disposed in said housing bore;

a second electrical contact movably disposed in said housing bore between an open position, wherein said second electrical contact is spaced apart from said first electrical contact, and a closed position, wherein said second electrical contact is in electrical contact with said first electrical contact;

two spaced apart frangible insulative plates disposed in said housing bore between said first and second electrical contacts when said second electrical contact is in said open position, said frangible insulative plates being adapted to be broken by said second electrical contact as said second electrical contact is moved to said closed position; and a viewing port disposed in said insulative housing wall between said two frangible insulative plates to permit viewing of said first electrical contact within said housing bore.

12. An electrical switch comprising:

an insulative housing having a wall defining an axial bore therein;

a first electrical contact disposed in said housing bore;

a second electrical contact movably disposed in said housing bore between an open position, wherein said second electrical contact is spaced apart from said first electrical contact, and a closed position, wherein said second electrical contact is in electrical contact with said first electrical contact; and at least one frangible insulative plate disposed in said housing bore between said first and second electrical contacts when said second electrical contact is in said open position, said frangible insulative plate being adapted to be broken by said second electrical contact as said second electrical contact is moved to said closed position, wherein the at least one frangible insulative plate comprises glass.

13. An electrical switch comprising:

an insulative housing having a wall defining an axial bore therein;

a first electrical contact disposed in said housing bore;

a second electrical contact movably disposed in said housing bore between an open position, wherein said second electrical contact is spaced apart from said first electrical contact, and a closed position, wherein said second electrical contact is in electrical contact with said first electrical contact; and at least one frangible insulative plate disposed in said housing bore between said first and second electrical contacts when said second electrical contact is in said open position, said frangible insulative plate being adapted to be broken by said second electrical contact as said second electrical contact is moved to said closed position, wherein two, spaced apart frangible insulative plates are disposed in said housing bore between said first and second electrical contacts.

14. An electrical switch comprising:

an insulative housing having a wall defining an axial bore therein;

a first electrical contact disposed in said housing bore;

a second electrical contact movably disposed in said housing bore between an open position, wherein said second electrical contact is spaced apart from said first electrical contact, and a closed position, wherein said second electrical contact is in electrical contact with said first electrical contact; and at least one frangible insulative plate disposed in said housing bore between said first and second electrical contacts when said second electrical contact is in said open position, said frangible insulative plate being adapted to be broken by said second electrical contact as said second electrical contact is moved to said closed position, wherein the electrical switch is a high current switch and said at least one frangible insulative plate reduces the occurrence of flashover when said contacts are in said open position.

15. An electrical switch as defined in claim 14, wherein said first electrical contact comprises a male pin having a first end and a second end formed by a pair of resilient slotted legs and a central axial bore in said second end, and said second electrical contact comprises a female socket having a substantially cylindrical side wall and a bottom surface which define a cavity, an open end and a post that extends from the bottom surface, and wherein the male pin slotted legs are received in and in electrical contact with the female socket cavity, and wherein the female socket post is received in and electrical contacts with the bore in the second end of the male pin whereby the second end of the pin is trapped in said female socket between the cavity and post.

16. An electrical switch as defined in claim 15, wherein the second end of said male pin is tapered.

17. An electrical switch as defined in claim 15, wherein the cavity of the female socket includes a roughened surface to engage the outer surface of said male pin.

18. An electrical switch as defined in claim 15, wherein the post includes a roughened outer surface to engage the bore in the second end of the male pin.

19. An electrical switch as defined in claim 15, wherein the cavity in the female socket is vented to allow trapped gasses to escape presenting backoff pressure.

20. An electrical switch as defined in claim 14, further comprising an insulating seal for electrically insulating said movable second electrical contact in said housing, said seal including a body having an outer wall defining an outer sealing surface and an inner wall defining an inner sealing surface, wherein the outer sealing surface is adapted to be sealably received by said housing and the inner sealing surface is adapted to sealably receive a portion of the movable electrical contact, and wherein the body comprises first and second insulating materials such that the outer wall is formed of a first material having a first durometer and the inner wall is formed of a material having a second durometer, such that the second durometer is greater than the first durometer.

21. An electrical switch as defined in claim 14, further comprising an insulating seal for electrically insulating said movable second electrical contact in said housing, said seal including a body having an outer wall defining an outer sealing surface and an inner wall defining an inner sealing surface, wherein the outer sealing surface sealingly engages the housing, and the inner sealing surface sealingly engages a portion of the movable second electrical contact, wherein the body comprises a substantially rigid annular ring and an elastomeric insulating material surrounding the ring such that the seals with the housing and rod are substantially independent.

22. An electrical switch as defined in claim 21, wherein the annular ring is formed of plastic and the elastomeric material is formed of rubber.

23. An electrical switch as defined in claim 14, further comprising a viewing port disposed in said insulative housing wall adjacent said first electrical contact to permit viewing of said first electrical contact within said housing bore.

24. An electrical switch as defined in claim 23, wherein said viewing port comprises a transparent element positioned within said housing wall.

25. An electrical switch as defined in claim 24, wherein said transparent element is made from a clear insulative plastic material.

26. An electrical switch as defined in claim 24, wherein said transparent element is provided with magnification to enhance viewing.

27. An electrical switch as defined in claim 24, wherein said housing wall includes a protruding boss portion having a hole for receiving said transparent element.

28. An electrical switch comprising:

an insulative housing having a wall defining an axial bore therein;

a first electrical contact disposed in said housing bore;

a second electrical contact movably disposed in said housing bore between an open position, wherein said second electrical contact is spaced apart from said first electrical contact, and a closed position, wherein said second electrical contact is in electrical contact with said first electrical contact; and at least one frangible insulative plate disposed in said housing bore between said first and second electrical contacts when said second electrical contact is in said open position, said frangible insulative plate being adapted to be broken by said second electrical contact as said second electrical contact is moved to said closed position, wherein said first electrical contact comprises a female socket including an inner roughened surface to engage the second electrical contact, said roughened surface providing a scraping action on the second electrical contact during engagement therewith to prevent broken shards of said insulative plate from interfering with electrical connection between the first and second electrical contacts.

29. An electrical switch as defined in claim 28, further comprising a viewing port disposed in said insulative housing wall adjacent said first electrical contact to permit viewing of said first electrical contact within said housing bore.

* * * * *